US010625103B2

(12) United States Patent
Ehler et al.

(10) Patent No.: US 10,625,103 B2
(45) Date of Patent: Apr. 21, 2020

(54) BLOWER FILTER RESPIRATOR SYSTEM

(71) Applicant: Dräger Safety AG & Co. KGaA, Lübeck (DE)

(72) Inventors: Björn Ehler, Lübeck (DE); Achim Volmer, Lübeck (DE); Martin Schulze, Bad Kleinen (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 853 days.

(21) Appl. No.: 15/068,997

(22) Filed: Mar. 14, 2016

(65) Prior Publication Data

US 2016/0271428 A1 Sep. 22, 2016

(30) Foreign Application Priority Data

Mar. 17, 2015 (DE) ..... 10 2015 003 385

(51) Int. Cl.
*A62B 9/00* (2006.01)
*A62B 18/00* (2006.01)
*A62B 17/04* (2006.01)

(52) U.S. Cl.
CPC ..... *A62B 9/006* (2013.01); *A62B 17/04* (2013.01); *A62B 18/006* (2013.01)

(58) Field of Classification Search
CPC .... A62B 7/00; A62B 7/10; A62B 9/00; A62B 9/003; A62B 9/006; A62B 18/006; A61M 16/021; A61M 16/0051; A61M 16/0057; A61M 16/0066; A61M 16/0069; A61M 16/06; A61M 2205/13
USPC ..... 137/487
See application file for complete search history.

(56) References Cited

U.S. PATENT DOCUMENTS 5,577,496 A * 11/1996 Blackwood ..... A62B 18/006 128/201.25
5,950,621 A * 9/1999 Klockseth ..... A62B 9/006 128/201.25
6,017,315 A * 1/2000 Starr ..... A61M 16/06 600/529

(Continued)

FOREIGN PATENT DOCUMENTS

DE 689 09 707 T2 2/1994
DE 10 2004 013 453 B4 7/2006

(Continued)

*Primary Examiner* — Colin W Stuart
*Assistant Examiner* — Matthew D Ziegler
(74) *Attorney, Agent, or Firm* — McGlew and Tuttle, P.C.

(57) ABSTRACT

A blower filter respirator system (1) has a filter element (3) for filtering ambient air (33), a blower unit (30) and a face part (7) with a tube element (9)—face part/tube combination (79)—for feeding an amount of breathing air (37) to a user (100). A pressure sensor (8) is on an outlet side (35) of the blower unit (30) measuring breathing air pressure values (81) by detecting a pressure difference on the outlet side (35) of the blower unit (30) against the ambient air (33). A control unit (5) is configured to operate the blower unit (30) and control breathing air (37) and is configured to determine a desired pressure value (83) for current operation with the face part/tube combination (79) from operation-related properties (530) of the blower unit (30) and specific properties of the face part/tube combination (79) and for comparing with the current pressure value (81).

8 Claims, 2 Drawing Sheets

(56) References Cited

U.S. PATENT DOCUMENTS

| | | | | |
|---|---|---|---|---|
| 6,968,842 | B1 * | 11/2005 | Truschel | A61M 16/024 128/204.18 |
| 7,367,338 | B2 * | 5/2008 | Baecke | A61M 16/024 128/203.14 |
| 2004/0118403 | A1 * | 6/2004 | O'Connor | A61M 16/00 128/204.23 |
| 2006/0278222 | A1 * | 12/2006 | Schermeier | A61M 16/08 128/204.18 |
| 2009/0266361 | A1 * | 10/2009 | Bilger | A62B 7/10 128/204.21 |
| 2011/0114093 | A1 | 5/2011 | Patil et al. | |
| 2012/0291783 | A1 * | 11/2012 | Peiris | A61M 16/0051 128/204.21 |
| 2014/0311490 | A1 * | 10/2014 | Volmer | F04D 27/004 128/204.21 |
| 2015/0165142 | A1 * | 6/2015 | Tham | A61M 16/08 128/202.22 |

FOREIGN PATENT DOCUMENTS

| | | | |
|---|---|---|---|
| EP | 0 413 555 | A1 | 2/1991 |
| EP | 08 14 872 | B1 | 1/2005 |
| FR | 2 705 899 | A1 | 12/1994 |
| WO | 01/80952 | A1 | 11/2001 |

* cited by examiner

BLOWER FILTER RESPIRATOR SYSTEM

CROSS REFERENCE TO RELATED APPLICATIONS

This application claims the benefit of priority under 35 U.S.C. § 119 of German Patent Application 10 2015 003 385.9 filed Mar. 17, 2015, the entire contents of which are incorporated herein by reference.

FIELD OF THE INVENTION

The present invention pertains to a blower filter respirator system. Blower filter respirators and blower filter respirator systems protect the user of such devices from gases and/or vapors as well as particles that are present in the breathing air and may be harmful to the health of the user.

BACKGROUND OF THE INVENTION

A blower filter respirator system has at least one filter for filtering the ambient air as well as a face part, via which the filtered air is fed to the user. Such a face part is frequently also called headpiece for a blower filter respirator system. Blower filter respirator systems are used in many situations and fields of use in everyday life as well as in industrial environments.

The fields of use include, for example, the production and processing of metals (e.g., iron and steel industry), metal-working (e.g., welding, soldering), the pharmaceutical industry, chemical industry, fields of application in coating technology or paint and varnish technology, the oil and gas industry, services in the areas of construction, reconstruction, disposal or cleaning up (e.g., cleaning up of asbestos) or the handling of hazardous materials, as well as clinical/medical fields of use, for example, applications for the protection of the medical staff from pathogens in case of epidemics and pandemics. Depending on the nature of the conditions of use, the face part may be a face mask, a breathing hood, a visor mask, a helmet, a full face mask or a half mask. The blower filter device and the face part are connected via an air feed line, so that the amount of air delivered by the blower filter device can be fed and sent to the user.

Blower filter respirator systems, which are also called "PAPR" (Powered Air Purifying Respirator) systems, are known, for example, from DE 689 09 707 T2, DE 100 21 581 B4, EP 08 14 872 B1 and EP 0 413 555 A1.

It is important for the action of a blower filter respirator system for protecting the user from harmful gases or particles that there is an overpressure in the face part against the ambient air. This ensures that no air can enter the face part from the surrounding area. It is described in the state of the art, for example, in EP 0 814 872 B1, how it is possible by means of a pressure sensor, which is arranged in the face mask, to monitor whether an overpressure is present in the face mask relative to the area in which the mask is used. The inclusion of the pressure enables the management of the blower filter device in a possible technical embodiment variant to monitor the overpressure in the mask with a corresponding possibility of alarming for the control of the blower filter respirator system when the pressure drops. The drawback of this technical embodiment variant is the necessity of a data link between the blower filter device and the pressure sensor in the mask. Such a data link, be it wired or wireless via radio transmission or optical transmission, is, in principle, prone to disturbances during the use of the blower filter device (cable rupture, contact problems on plug-type connections, disturbances in radio transmission) and is thus problematic.

Another technical embodiment variant of detecting a pressure in the face mask is the arrangement of a pressure-measuring line from the face mask to the blower filter device. A pressure sensor, which can detect the pressure in the face mask by measurement by means of the pressure-measuring line, is arranged in the blower filter device. This embodiment variant also has the drawback that the pressure-measuring line is susceptible to disturbances, e.g., damage to the pressure-measuring line from the outside during use. Arranging the pressure-measuring line in the air feed line ("tube-in-tube"), often designed as a tube from the blower filter device to the face mask, reduces the susceptibility to disturbances from the outside, but it requires a special and complicated and therefore expensive design of the air feed line or of the tube.

SUMMARY OF THE INVENTION

In view to the described drawbacks of the state of the art, an object of the present invention is to provide a blower filter respirator system with a face part and with a blower filter device, which provides for monitoring a pressure in the face part without a data line along an air feed line from the blower filter device to the face part being necessary.

According to the invention, a blower filter respirator system is provided comprising a filter element configured to purify ambient air, a blower unit configured to drawing in ambient air on an inlet side through the filter element and to generate an amount of breathing air on an outlet side, a face part configured as a breathing mask, as a visor mask or as a breathing hood for feeding the amount of breathing air to a user and an air feed line configured to feed the amount of breathing air from the outlet side of the blower unit to a user. A pressure sensor is arranged on the outlet side of the blower unit and configured to measure a pressure difference of the breathing air on the outlet side of the blower unit and the ambient air, as a current pressure value. A memory is provided that is configured to make available specific properties of the face part/tube combination and operation-related properties of the blower unit. A control unit is provided that is configured to operate the blower unit to control the amount of breathing air. The face part with the tube element forms a face part/tube combination. The memory is provided in or at the control unit. The control unit is further configured to determine a desired pressure value for a current operation of the blower filter respirator system with the face part/tube combination from the operation-related properties of the blower unit and the specific properties of the face part/tube combination. The control unit is further configured to detect a current pressure value of the pressure sensor to comparing the current pressure value of the pressure sensor with the determined desired pressure value and for generating and making available a specific error signal if the current measured pressure value drops below this desired pressure value.

The blower filter respirator system is provided with the filter element, the blower unit and the face part. The blower unit is configured and provided on an inlet side for drawing in ambient air through the filter element. Furthermore, the blower unit is provided for generating an amount of breathing air on the outlet side and for making it available for the air feed line. The filter element is configured and intended to clean ambient air and the filter element brings about the removal of particles from the ambient air, so that the amount of breathing air made available by the blower unit consists of purified air. The blower unit preferably has a rotating blower coupled in a non-positive manner with an electric drive motor with an impeller or a fan impeller for generating and delivering the amount of breathing air. The blower is preferably designed as a radial compressor. The electric drive motor is preferably designed as a DC motor, more preferably as an electronically commutated DC motor (DC brushless motor) and is suitable and intended for putting the blower wheel into rotation. The face part may be designed according to different variants, for example, as a breathing mask, a breathing hood, a visor mask, a helmet, a full face mask or a half mask. Furthermore, a control unit and an energy supply unit, as well as a sensor system for detecting pressure and flow rates are arranged in the blower filter respirator system. The face part is connected to the blower unit via an air feed line in such a way that an amount of air delivered by the blower unit can be delivered to the face part by means of the air feed line. The air feed line is typically designed as a flexible tube element, preferably as an elastic tubing or a breathing tube, which is suitable for guiding air under harsh conditions of use (heat, fire, water, cold). The sensor system comprises measuring elements for detecting pressures or amounts of air as well as states or operating states of the blower unit. Thus, the sensor system includes, for example, pressure sensors, for example, for detecting the ambient pressure, flow sensors for detecting the flow rates delivered by the blower unit or speed of rotation sensors for detecting the speed of rotation of the blower unit.

The control unit is configured and intended for controlling the amount of breathing air by means of regulation or control on the basis of the sensor system as well as for the operation of the blower unit and the analysis of the signals of the sensor system. The control unit is provided, for example, with a microcontroller (μC) or a microprocessor (μP) and has inputs and outputs for measured signals, data and control signals in order to make possible the control and operation of the blower filter respirator system with a program code, which is run on the microcontroller (μC) or microprocessor (μP). The energy supply unit is preferably designed as a rechargeable battery with a corresponding voltage and/or current electronic unit as well electronic charging unit and is suitable and intended for supplying the sensor system, the drive motor and the control unit with electric power. The sensor system comprises according to the present invention a pressure sensor, which is arranged on an outlet side of the blower unit. The pressure sensor is configured and intended for detecting by measurement a pressure difference of the amount of breathing air on the outlet side of the blower unit against the ambient pressure as a current pressure value.

According to the present invention, the face part and the air feed line form a face part/tube combination. Furthermore, a memory, which is configured and intended for providing and storing specific properties of the face part/tube combination and operation-related properties of the blower unit, is provided in or at the control unit. Operation-related parameters of the blower unit are, for example, a delivered volume flow or mass flow of air, a temperature of the air being delivered, a speed of rotation of the blower wheel or a pressure level, which corresponds to the speed of rotation and which is generated by means of the rotation of the blower wheel.

Due to the amount of breathing air being delivered, the pressure is higher on the outlet side of the blower unit than the pressure of the ambient air during the operation of the blower unit if there is no free outflow on the outlet side of the blower unit. This means that the pressure sensor measures an overpressure, which is consequently present on the outlet side of the blower unit, against the ambient pressure when the face part/tube combination is connected. The control unit is configured and intended, moreover, according to the present invention for determining a desired pressure value for the current operation of the blower filter respirator system with the currently connected face part/tube combination from the operation-related properties of the blower unit and the specific properties of the face part/tube combination. This desired pressure value is a pressure value that must be given at the air outlet of the blower unit for a safe operation of the blower filter respirator system and is indirectly also given in the face part via the connection of the face part by means of the tube element with the air outlet in order to ensure a reliable supply of a user with breathing air through the blower filter respirator system. Knowing the specific properties of the face part/tube combination, especially if the flow rate being delivered by the blower unit and the flow resistances (flow resistance of the tube element and flow resistance of the face part) of the face part/tube combination are known, the control unit is able to determine the overpressure in the face part, which occurs during the operation of the blower filter respirator system, from the pressure value at the air outlet of the blower unit.

The control unit is configured and intended for detecting the current pressure value of the pressure sensor arranged on the outlet side of the blower unit and for comparing it to the desired pressure value determined from the operation-related properties of the blower unit and the specific properties of the face part/tube combination and for generating and providing an error signal if the current measured pressure value drops below the determined desired pressure value. The fact that the currently detected measured pressure value drops below the determined desired pressure value means that an excessively low pressure, which is not sufficient for preventing suspended or foreign bodies as well as air containing pollutants from entering the face part from the outside, is available to the user in the face part. The user is therefore alerted by the error signal that there is currently no safe operating state during the operation of the blower filter respirator system.

It is made possible in this manner with the present invention to determine, in the knowledge of the operation-related properties of the blower unit and the specific properties of the face part/tube combination, a desired pressure value, which is compared during the current operation or during the operation of the blower filter respirator system by means of the control unit with the current measured pressure value at the air outlet of the blower unit, [in order] to determine whether a safe operating state is present or whether a state of error, which is hazardous to the user's health, is present for the user due to an excessively low overpressure at the air outlet of the blower unit.

In a special embodiment of the present invention, the memory at the blower filter respirator system is configured to provide the specific properties of a plurality of face part/tube combinations. The specific properties of the plurality of face part/tube combinations are preferably provided in the memory in the form of operation codes. This special embodiment of the present invention makes it possible to specifically determine a desired pressure value each not only for one face part/tube combination but for a plurality of different face part/tube combinations, and this desired pressure value is compared during the current operation or operation of the blower filter respirator system with the current measured pressure value at the air outlet of the blower unit by means of the control unit in order to determine whether a safe operating state of the blower filter respirator system is present with a face part/tube combination selected from the plurality of different face part/tube combinations or whether there is a state of error for the user, which is hazardous to the user's health, due to the fact that, as a specific feature of the face part/tube combination from the plurality of different face part/tube combinations, the overpressure is too low at the air outlet of the blower unit. By storing specific properties of a plurality of face part/tube combinations in the memory, it is possible to take into account different face parts or tube designs. Different face parts are, for example, types of breathing masks, breathing hoods, visor masks, helmets, full face masks or half masks. Different tube designs are obtained, for example, due to the shape of the tube (spiral tube, round tube, coaxial tube), tube diameters, tube lengths and tube materials and the degree of elasticity and mobility of the different face parts or tube designs. The specific properties of the many different face part/tube combinations also lead, in part, directly to conditions for the manner of operation of the face part/tube combinations with the blower filter respirator system. For example, the necessary overpressure against the surrounding area is thus different in a tightly fitting breathing mask for avoiding the entry of foreign particles into the breathing mask from the overpressure necessary against the surrounding area in case of a breathing hood or a half mask. In addition, the flow rate to be delivered by the blower unit and needed during the use is different with the use of the tightly fitting breathing mask with an exemplary range of flow rates of 115 L/minute to 145 L/minute from the flow rate needed during the use with the use of a breathing hood with an exemplary range of flow rates of 170 L/minute to 210 L/minute. The different ranges of flow rates and the difference between a tightly fitting breathing mask and a less tightly fitting breathing hood lead to different pressure ratios in the breathing mask and the breathing hood, which will then also be manifested in the necessary overpressure in the respective face part as well as in the overpressure of the amount of breathing air being delivered, which overpressure is necessary for this at the air outlet of the blower unit. This shows that different desired pressures or desired pressure ranges will result for different face parts or face part/tube combinations, and these desired pressures also must consequently be given at the air outlet of the blower unit in order to guarantee at the face part an overpressure that reliably prevents the entry of foreign particles into the face part from the outside. These properties and peculiarities are stored in the memory in the specific properties of many different face part/tube combinations in the form of the operation codes as well as a part of the operation-related properties of the blower unit. Additional variables, which may be stored in the specific properties of the face part/tube combinations, are, for example, the respective tube length, the tube diameter, the type of the tube connection, for example, threaded connections (e.g., by means of a so-called Rd40 thread), different types of plug-type or snap-on connections, the corresponding flow resistance of the face part/tube combination, associated with the corresponding type of face part (breathing mask, half mask, breathing hood) as part of the face part/tube combinations. The operation codes stored in the memory with association with the face part/tube combination currently being used by the user during the operation may be selected in different ways.

A possibility of achieving such a selection arises in another preferred embodiment such that the user selects a corresponding type of blower filter respirator system, which corresponds to the particular face part/tube combination he uses. An input element (button, switch, keyboard), via which the user is able, ideally before the beginning of the operation, to select the proper face part/tube combination for the operation from the plurality of possible face part/tube combinations, is preferably present for this on the blower filter respirator system.

Another possibility is available in another preferred embodiment of the blower filter respirator system in such a way that a characteristic data memory element is arranged in or at the tube element or the air feed line. A code of the respective face part/tube combination is stored and provided in this characteristic data memory element. The blower filter respirator system with the control unit is configured and provided for this to compare the code of the face part/tube combination in the characteristic data memory element with the operation code in the memory of the blower filter respirator system and to determine from this the specific properties of the face part/tube combination and to determine the desired pressure value for the operation of the blower filter respirator system with the connected face part/tube combination. This code is configured such as to store and provide the specific properties of this face part/tube combination. In addition, a reading unit, which is configured to read the code from the characteristic data memory element of the face part/tube combination, is connected to the control unit or is integrated in the control unit in this other preferred embodiment. The control unit uses the operation code in the memory of the blower filter respirator system and the code from the characteristic data memory element of the tube element and then determines from this the specific properties of the face part/tube combination currently connected to the blower unit. The desired pressure value for the connected face part/tube combination is then determined by the control unit on the basis of these specific properties of the face part/tube combination currently connected to the blower unit, which properties are then determined.

In a preferred variant of this other preferred embodiment, the characteristic data memory element in or at the tube element is configured as a radio frequency identification memory element, often also called RFID tag (RFID=radio frequency identification), which is fastened or arranged in or at the tube element or the air feed line. The reading unit is designated in such an embodiment as a radio frequency reading unit, often also called RFID reader or RFID reading unit, which is arranged in the blower filter respirator system, preferably in the vicinity of the blower outlet and is suitable for reading data from the radio frequency identification element.

In another preferred embodiment, fluidic and/or configuration/design-related properties of the blower unit are taken into account in the operation-related properties of the blower unit (the operation-related properties of the blower unit are a function of fluidic and/or configuration/design-related properties of the blower unit). These operation-related properties include, for example, flow resistances, in the blower unit, and flow properties, for example, flow resistances in connection pieces on the inlet side or on the outlet side of the blower unit with the filter element and/or with the tube element.

In a special embodiment, fluidic and/or configuration/design-related properties of the filter element are taken into account in the operation-related properties of the blower unit (the operation-related properties of the blower unit are a function of fluidic and/or configuration/design-related properties of the filter element). The fluidic properties of the filter element include, for example, a flow resistance in the unloaded state of the filter as well as a flow resistance in case of medium or maximum permissible loading of the filter with filtered suspended substances.

In another preferred embodiment of the blower filter respirator system, fluidic and/or configuration/design-related properties of the face part/tube combination are taken into account in the specific properties of the face part/tube combination (the specific properties of the face part/tube combination are a function of fluidic and/or configuration/design-related properties of the face part/tube combination). These include, for example, the flow resistance of the face part/tube combination, flow resistances in the air feed line, the tube length and the type of the face part, be it a hood or breathing mask, as well as the type of the connection elements of the tube element with the blower filter respirator system and/or with the face part.

Fluidic and/or configuration/design-related properties of the blower are taken into account in the operation-related properties of the blower unit (the operation-related properties of the blower unit are a function of fluidic and/or configuration/design-related properties of the blower) in another preferred embodiment of the blower filter respirator system.

Each of the above-described embodiments represents an independent embodiment and expansion of the inventive idea. However, combinations of the embodiments described as well as the use of individual features of individual embodiments in other embodiments or combinations of embodiments shall also be covered in the sense of the present invention.

The present invention will be explained in more detail by means of a schematic view of a blower filter respirator system by means of the following FIGURE and the corresponding description of the FIGURE without limitation of the general inventive idea. The present invention is described in detail below with reference to the attached FIGURES. The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1:
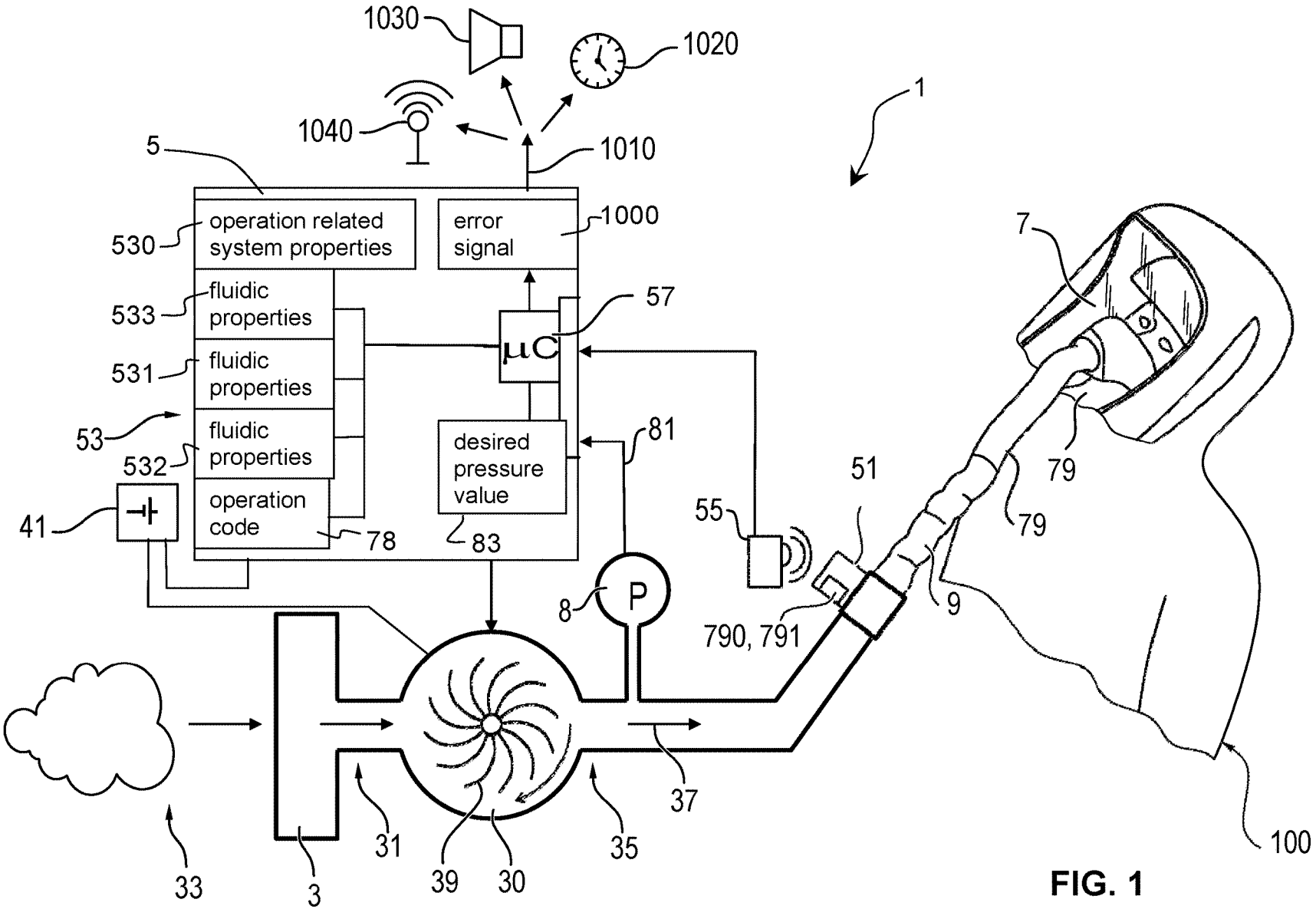
FIG. 1 is a schematic view of a blower filter respirator system with a memory located in or on a control unit.
Figure 2:
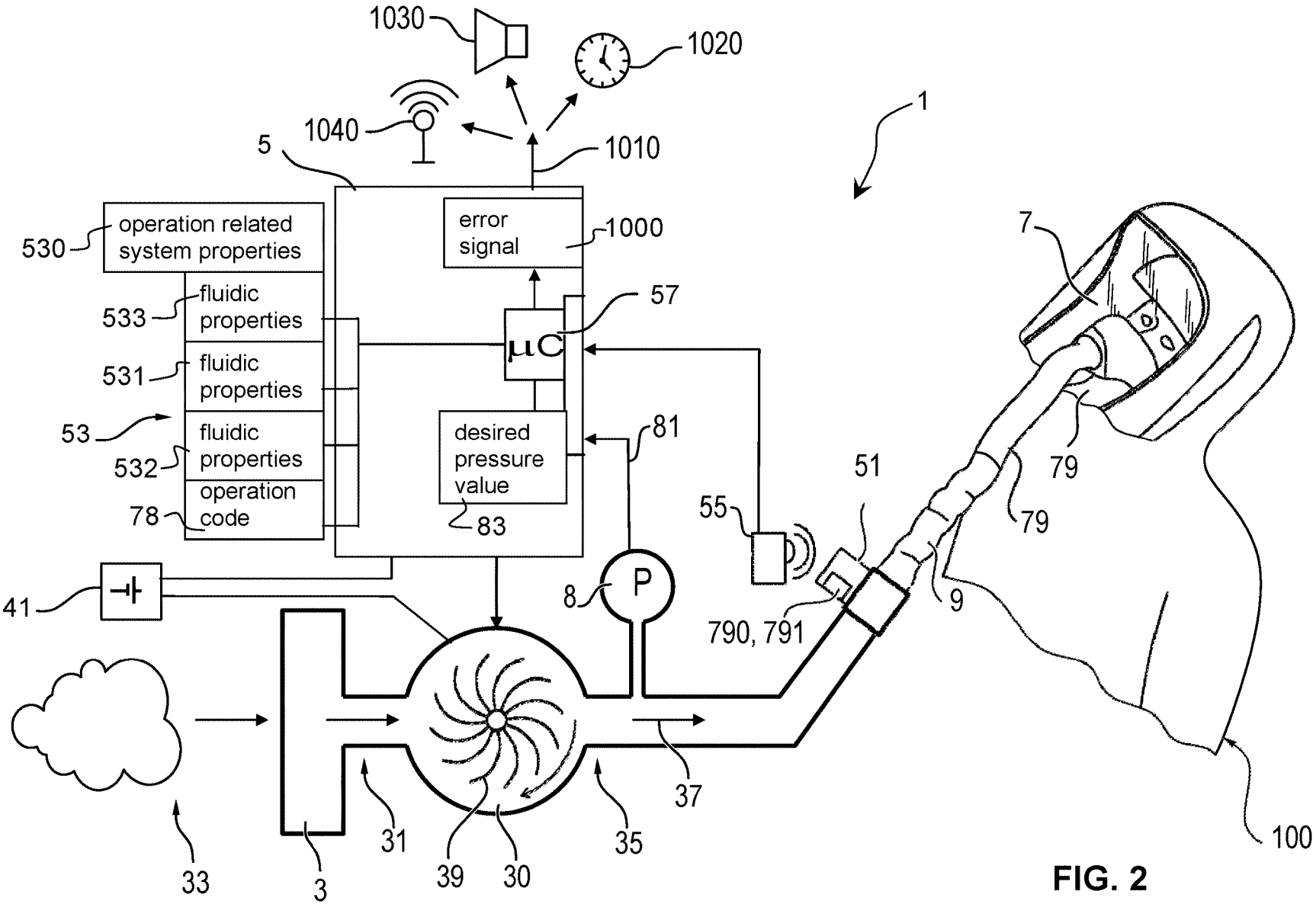
FIG. 2 is a schematic view of a blower filter respirator system with a memory located adjacent to and connected to a control unit.

Referring to the drawings, the blower filter respirator system 1 has as its components a filter element 3, a control unit 5, a face part 7, a pressure sensor 8, an air feed line, which is configured as a tube element 9, and a blower unit 30. An air inlet 31 is arranged at the blower unit 30 on an inlet side and an air outlet 35 is arranged on an outlet side. A blower (fan) 39 is arranged in the blower unit 30. The blower unit draws in ambient air through the filter element 3 from a surrounding area 33 by means of the blower 39 on the inlet side at the air inlet 31 and delivers the purified air as an amount of breathing air 37 to the air outlet 35 of the outlet side by means of the blower 39. The face part 7 is arranged at a user 100 and is used to supply the user 100 with the amount of breathing air 37 delivered. The face part 7 may have different designs, for example, as a breathing mask, half mask or breathing hood and forms, together with the air feed line or the tube element 9, a face part/tube combination 79. A pressure sensor 8, which is configured and intended to detect a current measured pressure value 81 as a pressure difference on the outlet side 35 of the blower unit 30 against the ambient air 33, is arranged on the outlet side 35. The control unit 5 is configured and intended for operating the blower unit 30 with control of the amount of breathing air 37 as well as for analyzing the pressure sensor 8 The control unit preferably has a microcontroller (μC) 57, which is configured and intended for controlling the operation of the blower filter respirator system 1 by means of a suitable programming. The control unit 5 has a memory 53. Operation-related system properties 530 are stored in the memory 53 and are made available to the control unit 5. The operation-related system properties 530 include fluidic properties 532 of the blower unit 30, fluidic properties 531 of the filter element 3, as well as fluidic properties 533 of the blower 39. Furthermore, an operation code 78 of at least one face part/tube combination 79 is stored in the memory 53. Both the type or different types of face part/tube combinations 79 or of the face part (breathing mask, half mask, breathing hood) may be entered into, stored and made available as operation code 78 or operation codes in the memory. It is, however, also possible to store data that are based on the specific properties 790 of the face part/tube combination 79 or data that directly represent specific, for example, fluidic and/or configuration/design-related properties 791 of face part/tube combinations 79.

A battery 41 is arranged in the blower filter respirator system 1 as an energy supply component 41 for supplying the electric and sensory components 5, 8, 30, 39 of the blower filter respirator system 1. A characteristic data memory element 51 is arranged at the tube element 9. The characteristic data memory element 51 may be fastened to the tube element 9, for example, by means of bonding or a tube clamp or embedded in the material of the tube element 9, for example, vulcanized onto or into the material. As a memory element with radio frequency identification technology, the characteristic data memory element 51 is also often called and designed in this FIGURE as RFID tag (RFID=radio frequency identification) and is configured for storing specific properties 790 of the respective face part/tube combination 79 and to make it available to a reading unit 55. A reading unit (RFID reader) 55 suitable for reading the characteristic data memory element 51 is arranged at the control unit 5. Fluidic and/or configuration/design-related properties 791 of the face part/tube combination 79, for example, the length of the tube, tube diameter, type of tube connection, flow resistance of the face part/tube combination 790 as well as a type identifier of the face part (breathing mask, half mask, breathing hood) or of the face part/tube combination 79 are taken into account in the specific properties 790 of the face part/tube combination 79, specifically depending on the type of the face part (breathing mask, half mask, breathing hood). If the face part/tube combination 79 is arranged on the blower unit 30 during the use of the blower filter respirator system 1, the specific properties 790 of the face part/tube combination 79 just connected are read by the control unit 5 by means of the reading unit 55 from the characteristic data storage element 51. The operation code 78 is likewise read by the control unit from the memory 53. The control unit 5 processes the specific properties 790 and the operation code 78 with inclusion of the operation-related system properties 530 and determines in the process the use and operation conditions and circumstances applicable to the connected face part/tube combination 79 for the current use of the blower filter respirator system 1. The operating conditions comprise essentially the range of the amount of breathing air 37, which, drawn in by the blower unit 30 from the surrounding area 33 through the filter element 3 at the air inlet 31, is delivered through the blower 39 to the air outlet 35 and from there to the face part 7 to the user 100 via the tube element 9.

Two different operating conditions for two different face parts 7 shall be mentioned here as an example. An exemplary flow rate 37 of 115 L/minute to 145 L/minute is delivered into a breathing mask, which is tightly adapted to the face of the user 100, by the blower unit 30. Compared to the tightly fitting breathing mask, a larger exemplary flow rate 37 of 170 L/minute to 210 L/minute is delivered by the blower unit 30 into a breathing hood, which is adapted only loosely to the face of the user 100, in order to ensure that no particles will enter into or under the breathing hood from the outside. The determined use and operating conditions comprise, furthermore, a desired pressure value 83, which is specifically relevant for the use situation with the face part/tube combination 79 currently being used during the use of the blower filter respirator system 1, and which is used for the control unit 5 as the basis for a comparison with the current measured pressure value 81, in order to check whether the blower filter respirator system 1 is being operated in safe manner for the user 100 with overpressure against the surrounding area 33. Thus, the particular flow rate 37 being delivered and the type of the face part/tube combination 79 connected are thus available to the control unit 5 in order to determine the desired pressure value 83, which is necessary at the air outlet 35 and which corresponds to a use situation at the face part 7, in which situation it is ensured that the breathing mask is tightly in contact with the face of the user 100 and the tube element 9 or the connection at the air outlet 35 or the breathing hood has no leaks, so that no particles can enter into the breathing mask or under the breathing mask from the outside. The control unit 5 then detects continuously current measured pressure values 81 at the air outlet 35 during the current operation and compares these measured pressure values 81 with the desired pressure value 83 determined before for the current use situation. If the control unit 5 detects that the detected measured pressure value 81 is below the desired pressure value 83, the control unit 5 generates an error signal 1000. Via an error signal output 1010 arranged at the blower unit 30, the control unit 5 then transmits the error signal 1000 to optical alarm generation means 1020, for example, a light source, lamp or LED or acoustic alarm generation means 1030, for example, a horn or a sound generator. In addition, alarm transmission of the error signal 1000 to the outside, to other persons, to the face part 7 of the user 100, for example, by means of a radio interface 1040, [and] to the blower filter respirator system 1 may be provided.

While specific embodiments of the invention have been shown and described in detail to illustrate the application of the principles of the invention, it will be understood that the invention may be embodied otherwise without departing from such principles.

APPENDIX

| List of Reference Numbers | |
|---|---|
| 1 | Blower filter respirator system |
| 3 | Filter element |
| 5 | Control unit |
| 7 | Face part |
| 8 | Pressure sensor |
| 9 | Air feed line, tube element |
| 30 | Blower unit |
| 31 | Air inlet, inlet side |
| 33 | Surrounding area, ambient air |
| 35 | Air outlet, outlet side |
| 37 | Amount of breathing air, flow |
| 39 | Blower (fan) |
| 41 | Battery/energy supply component |
| 51 | Characteristic data memory element |
| 53 | Memory |
| 55 | Reading unit (RFID reader) |
| 57 | Microcontroller (C) |
| 78 | Operation code |
| 79 | Face part/tube combination |
| 81 | Current measured pressure value |
| 83 | Desired pressure value |
| 100 | User |
| 530 | Operation-related system properties |
| 531 | Fluidic properties of the blower unit 30 |
| 532 | Fluidic properties of the filter element 3 |
| 533 | Fluidic properties of the blower 39 |
| 790 | Specific properties of the face part/tube combination |
| 791 | Fluidic properties of the face part/tube combination |
| 1000 | Error signal |
| 1010 | Error signal output |
| 1020 | Alarm generation means (optical) |
| 1030 | Alarm generation means (acoustic) |
| 1040 | Alarm transmission, radio interface |

What is claimed is:

1. A blower filter respirator system comprising:

a filter element configured to purify ambient air;

a blower unit configured to draw in ambient air on an inlet side through the filter element and to generate an amount of breathing air on an outlet side;

a face part configured as a breathing mask or configured as a visor mask or configured as a breathing hood, the breathing mask or visor mask or breathing hood face part for feeding the amount of breathing air to a user;

an air feed line comprising a tube element configured to feed the amount of breathing air from the outlet side of the blower unit to the user, the breathing mask or visor mask or breathing hood face part with the tube element forming a breathing mask or visor mask or breathing hood face part/tube combination;

a pressure sensor arranged on the outlet side of the blower unit and configured to measure a pressure difference of the breathing air on the outlet side of the blower unit and the ambient air, as a current pressure value;

a control unit memory configured to make available a plurality of operation codes of different breathing mask or visor mask or breathing hood face part/tube combinations and operation-related properties including specific properties of the breathing mask or visor mask or breathing hood face part/tube combination and operation-related properties of the blower unit;

a reading unit associated with the control unit;

a characteristic data memory element connected to and arranged at or in the tube element, the characteristic data memory element being configured to store and keep ready a combination code concerning the breathing mask or visor mask or breathing hood face part/tube combination to which the characteristic data memory element is connected; and a control unit configured to operate the blower unit to control the amount of breathing air generated, wherein:

the control unit memory is provided in or at the control unit;

the control unit is configured to receive, from the reading unit the combination code, read from the characteristic data memory element by the reading unit;

the control unit is further configured to determine a desired pressure value at the pressure sensor, corresponding to a desired overpressure in the face part, for a current operation of the blower filter respirator system with the breathing mask or visor mask or breathing hood face part/tube combination from the operation-related properties of the blower unit and the specific properties of the breathing mask or visor mask or breathing hood face part/tube combination;

the control unit is further configured to detect a current pressure value of the pressure sensor and to compare the current pressure value of the pressure sensor with the determined desired pressure value and to generate and make available a specific error signal if the current measured pressure value drops below this desired pressure value;

the control unit is further configured to compare the operation codes with the combination code and to determine therefrom the specific properties of the breathing mask or visor mask or breathing hood face part/tube combination and to determine the desired pressure value for the operation of the blower filter respirator system based on data associated with the determined breathing mask or visor mask or breathing hood face part/tube combination based on the combination code;

the operation-related properties of the blower unit are a function of fluidic properties of the blower unit and configuration properties of the blower unit and are a function of fluidic properties of the filter element and configuration properties of the filter element and specific properties of the breathing mask or visor mask or breathing hood face part/tube combination are a function of fluidic properties of the breathing mask or visor mask or breathing hood face part/tube combination and configuration properties of the breathing mask or visor mask or breathing hood face part/tube combination.

2. A blower filter respirator system in accordance with claim 1, wherein the blower unit comprises a blower with an impeller configured as a radial compressor.

3. A blower filter respirator system in accordance with claim 2, further comprising an electronically commuted DC motor wherein the blower is mechanically coupled with the electronically commuted DC motor and the impeller is put into rotation by the electronically commuted DC motor.

4. A blower filter respirator system in accordance with claim 2, wherein operation-related properties of the blower are a function of fluidic properties of the blower and configuration properties of the blower.

5. A blower filter respirator system comprising:

a filter element configured to purify ambient air;

a blower unit configured to draw in ambient air on an inlet side through the filter element and to output breathing air on an outlet side at an outlet side connection;

a breathing mask or visor mask or breathing hood face part and air feed line combination comprising a breathing mask or visor mask or breathing hood face part configured to feed an amount of breathing air to a user and an air feed line configured to feed the amount of breathing air from the outlet side of the blower unit to the breathing mask or visor mask or breathing hood face part, the feed line being conectable and disconnectable from the outlet side connection of the blower unit;

a pressure sensor arranged on the outlet side of the blower unit, upstream of the outlet side connection, the pressure sensor being configured to measure a pressure difference of the breathing air on the outlet side of the blower unit, upstream of the air feed line, and the ambient air, as a current pressure value;

a control unit memory configured with operation codes of specific properties of a plurality of different breathing mask or visor mask or breathing hood face part and air feed line combinations and operation-related properties including specific properties of the breathing mask or visor mask or breathing hood face part/tube combination and operation-related properties of the blower unit, with the operation code of each of the different breathing mask or visor mask or breathing hood face part and air feed line combinations being associated with a combination code;

a control unit connected to the blower unit and operatively connected to the control unit memory;

a characteristic data memory element connected to the tube element and arranged at or in the tube element, the characteristic data memory element storing and keeping ready the combination code concerning the breathing mask or visor mask or breathing hood face part/tube combination to which the characteristic data memory element is connected; and a reading unit connected to the control unit and positioned for reading the combination code, concerning the breathing mask or visor mask or breathing hood face part/tube combination connected to the blower unit, from the characteristic data memory, the control unit being configured to:

receive the read combination code from the reading unit, compare the read combination code with the operation code to access, from the control unit memory, the specific properties of the face part and air feed line combination and the operation-related properties of the blower unit corresponding to the read combination code;

operate the blower unit to control the amount of breathing air;

determine a desired pressure value at the outlet side of the blower unit for a current operation of the blower filter respirator system with the breathing mask or visor mask or breathing hood face part and air feed line combination from the operation-related properties of the blower unit and the specific properties of the breathing mask or visor mask or breathing hood face part and air feed line combination accessed from the control unit memory, wherein the determined desired pressure value at the outlet side of the blower unit is based on a determination of a desired overpressure in the breathing mask or visor mask or breathing hood face part connected to the blower unit, which overpressure occurs during the operation of the blower filter respirator system, based on the pressure value at the outlet side of the blower unit with the breathing mask or visor mask or breathing hood face part and air feed line combination connected to the blower unit, based on data associated with the combination code;

detect a current pressure value of the pressure sensor and compare the current pressure value of the pressure sensor with the determined desired pressure value and generate and make available a specific error signal if the current measured pressure value drops below this desired pressure value, wherein the operation-related properties of the blower unit are a function of fluidic and configuration properties of the blower unit and a function of fluidic and configuration properties of the filter element and specific properties of the breathing mask or visor mask or breathing hood face part and air feed line combination are a function of fluidic and configuration properties of the breathing mask or visor mask or breathing hood face part and air feed line combination.

6. A blower filter respirator system in accordance with claim 5, wherein the blower unit comprises a blower with an impeller configured as a radial compressor.

7. A blower filter respirator system in accordance with claim 6, further comprising an electronically commuted DC motor wherein the blower is mechanically coupled with the electronically commuted DC motor and the impeller is put into rotation by the electronically commuted DC motor.

8. A blower filter respirator system comprising:

a blower and filter assembly comprising a filter element configured to purify ambient air and a blower unit configured to draw in ambient air on an inlet side through the filter element and to output breathing air on an outlet side at an outlet side connection;

a breathing mask or visor mask or breathing hood face part and air feed line combination comprising a breathing mask or visor mask or breathing hood face part configured to feed an amount of breathing air to a user and an air feed line configured to feed the amount of breathing air from the outlet side of the blower unit to the breathing mask or visor mask or breathing hood face part, the feed line being conectable and disconnectable from the outlet side connection of the blower unit;

a characteristic data memory element connected to the breathing mask or visor mask or breathing hood face part and air feed line combination, which characteristic data memory element stores and keeps ready a combination code concerning the breathing mask or visor mask or breathing hood face part and air feed line combination to which the characteristic data memory element is connected, the characteristic data memory element being arranged at or in the tube element;

a pressure sensor arranged on the outlet side of the blower unit, upstream of the outlet side connection, the pressure sensor being configured to measure a pressure difference of the breathing air on the outlet side of the blower unit, upstream of the air feed line, and the ambient air, as a current pressure value;

a control unit memory configured with operation codes of specific properties of a plurality of different breathing mask or visor mask or breathing hood face part and air feed line combinations and associated operation-related properties including specific properties of the breathing mask or visor mask or breathing hood face part/tube combination and operation-related properties of the blower unit and configured to provide access, from the control unit memory, of specific properties of the breathing mask or visor mask or breathing hood face part and air feed line combination and operation-related properties of the blower unit associated with a combination code;

a reading unit connected to the blower and filter assembly for reading the combination code from the characteristic data memory element;

a control unit connected to the blower unit and operatively connected to the reading unit and to the control unit memory, the control unit being configured to:

receive the read combination code from the characteristic data memory element from the reading unit;

access, from the control unit memory, the specific properties of the breathing mask or visor mask or breathing hood face part and air feed line combination and the operation-related properties of the blower unit based on the operation code associated with the read combination code;

operate the blower unit to control the amount of breathing air;

determine a desired pressure value at the pressure sensor for a current operation of the blower filter respirator system with the breathing mask or visor mask or breathing hood face part and air feed line combination from the operation-related properties of the blower unit and the specific properties of the breathing mask or visor mask or breathing hood face part and air feed line combination accessed from the control unit memory, wherein the determined desired pressure value at the pressure sensor for a current operation of the blower filter respirator system with the breathing mask or visor mask or breathing hood face part and air feed line combination is based on a determination of a desired overpressure in the breathing mask or visor mask or breathing hood face part, which overpressure occurs during the operation of the blower filter respirator system, based on the pressure value at the air outlet of the blower unit with the breathing mask or visor mask or breathing hood face part and air feed line combination, based on data associated with the combination code; and detect a current pressure value of the pressure sensor and compare the current pressure value of the pressure sensor with the determined desired pressure value and generate and make available a specific error signal if the current measured pressure value drops below this desired pressure value.

* * * * *